US011346551B2

(12) United States Patent
Bouchard et al.

(10) Patent No.: US 11,346,551 B2
(45) Date of Patent: May 31, 2022

(54) WASTE GAS COMBUSTOR WITH SECONDARY AIR CONTROL AND LIQUID CONTAINMENT/VAPORIZATION CHAMBER

(71) Applicant: Emission RX Ltd, Airdrie (CA)

(72) Inventors: Justin Bouchard, Calgary (CA); Jeffrey Nelson, Calgary (CA)

(73) Assignee: Emission Rx Ltd., Airdrie (CA)

( * ) Notice: Subject to any disclaimer, the term of this patent is extended or adjusted under 35 U.S.C. 154(b) by 193 days.

(21) Appl. No.: 16/444,405

(22) Filed: Jun. 18, 2019

(65) Prior Publication Data

US 2019/0383485 A1 Dec. 19, 2019

Related U.S. Application Data

(60) Provisional application No. 62/687,006, filed on Jun. 19, 2018.

(51) Int. Cl.

| | |
|---|---|
| ***F23G 7/08*** | (2006.01) |
| ***F23G 5/44*** | (2006.01) |
| ***F23L 15/04*** | (2006.01) |

(52) U.S. Cl.

CPC ..... *F23G 7/085* (2013.01); *F23G 5/442* (2013.01); *F23L 15/04* (2013.01); *F23G 2206/00* (2013.01)

(58) Field of Classification Search

CPC .. F23G 2206/00; F23G 2206/10; F23G 5/442; F23G 7/085; F23L 15/04

See application file for complete search history.

(56) References Cited

U.S. PATENT DOCUMENTS 2,059,274 A * 11/1936 Piser ..... F24H 1/186 122/18.1
2,237,967 A * 4/1941 La Branche ..... F23D 3/00 431/335
2,499,864 A * 3/1950 Heller ..... F23D 5/00 431/201
2,819,758 A * 1/1958 Nagel ..... F23D 5/00 431/196
3,484,189 A * 12/1969 Hardison ..... F23G 7/066 423/210

(Continued)

*Primary Examiner* — Jorge A Pereiro
*Assistant Examiner* — Logan P Jones
(74) *Attorney, Agent, or Firm* — Kyle R Satterthwaite; Ryan W Dupuis; Ade & Company Inc.

(57) ABSTRACT

A gas flare for burning waste gas comprises a stack with an upper chimney space, a lower combustion chamber, and a burner having one or more flame outlets positioned in the combustion chamber. A primary combustion air intake of the burner is in fluid communication with an ambient air intake to source primary combustion air therefrom. An airflow control device resides in a position operable to regulate secondary air flow from the ambient air intake to the flame outlet of the burner without obstructing the primary combustion air intake of said burner. The stack features a double hull design to preheat the ambient air as it travels to the burner, and a liquid containment/vaporization chamber is installed below the burner in heat exchange relationship with the preheated airflow path to the burner, whereby the chamber is warmed by the pre-heated combustion air and radiant heat from the combustion chamber.

22 Claims, 4 Drawing Sheets

(56) References Cited

U.S. PATENT DOCUMENTS

| | | | | |
|---|---|---|---|---|
| 3,933,420 | A * | 1/1976 | Zink | F23G 7/08 431/202 |
| 4,137,036 | A * | 1/1979 | Straitz, III | F23G 7/085 431/202 |
| 6,875,010 | B1 * | 4/2005 | Oviatt | F23C 7/008 431/12 |
| 2004/0197719 | A1 * | 10/2004 | Chung | F23C 6/047 431/8 |
| 2015/0211734 | A1 * | 7/2015 | Tsumagari | B01F 5/0065 431/354 |

* cited by examiner

WASTE GAS COMBUSTOR WITH SECONDARY AIR CONTROL AND LIQUID CONTAINMENT/VAPORIZATION CHAMBER

CROSS-REFERENCE TO RELATED APPLICATIONS

This application claims benefit under 35 U.S.C. 119(e) of U.S. Provisional Application No. 62/687,006, filed Jun. 19, 2019, the entirety of which is incorporated herein by reference.

FIELD OF THE INVENTION

The present invention relates generally to waste gas combustion equipment for burning off excess combustible gas at hydrocarbon wells or other sites.

BACKGROUND

In the oil and gas industry and elsewhere, it is known practice to burn off excess combustible gas (waste gas), for example for the purpose of relieving pressure buildup in an enclosed system or vessel.

U.S. Pat. No. 6,875,010, the entirety of which is incorporated herein by reference, discloses a waste gas combustion apparatus with a double hulled design, where a burner located within a cylindrical inner hull is fed primary air through a primary intake port provided in the inner hull below the burner. An outer hull surrounds the inner hull to create an annular space therebetween through which ambient air is introduced to the primary intake port. Above the burner, a barometric valve is operable to open in response to increases in atmospheric wind speed or rate of gas flow to increase an amount of airflow, while reducing the speed of the airflow. A burner ring prevents the airflow from the barometric valve from extinguishing the flame, and helps impart a helical flow direction to the exhaust gas.

U.S. Pat. No. 7,811,081, the entirety of which is incorporated herein by reference, discloses another waste gas combustion apparatus, in which a steam pot positioned inside the combustion chamber and having an annular shape spanning around the burner receives the incoming stream of waste gas so that combustion heat can be used to vaporize contaminant liquids therein, before the stream of waste gas and vaporized liquids continue onward to a liquid tank situated below the burner to contain any non-vaporized liquids. From the liquid tank, the purified waste gas travels up to a mixer, where it's combined with combustion air and fed to the burner.

Despite such prior endeavors, there remains room for improvements and alternatives in the design of waste gas combustors.

SUMMARY OF THE INVENTION

According to one aspect of the invention, there is provided a waste gas combustion apparatus comprising:

a stack structure delimiting an interior space that comprises an upper chimney section and a lower combustion chamber situated below said upper chimney section;

an ambient air intake through which ambient air is admissible to the stack to feed combustion in the combustion chamber;

a burner supported in the interior space of the stack structure, said burner comprising a primary combustion air intake in fluid communication with the ambient air intake, and one or more flame outlets positioned in the combustion chamber in elevated relation to the primary combustion air intake;

a waste gas inlet connected to said burner; and an airflow control device residing in a position operable to regulate secondary air flow from the ambient air intake to the flame outlet of the burner without obstructing the primary combustion air intake of said burner.

Preferably the burner is a multi-tube burner assembly comprising a plurality of burner components distributed around a central area in which the airflow control device resides at an elevation below respective flame outlets of said burner tube assemblies.

Preferably said burner components are disposed in a non-linear array around the airflow control device.

Preferably said burner components are disposed in a circular array around the airflow control device.

Preferably said airflow control device comprises a butterfly damper.

Preferably said airflow control device is positioned within the interior space of the stack structure and is coupled to an actuator situated externally thereof.

Preferably the stack structure comprises an inner hull whose interior defines the chimney space and the combustion chamber, and an outer hull circumferentially surrounding the inner hull to delimit an annular space between the inner and outer hulls; the ambient air intake communicates the annular space with an external environment outside the outer hull; and the primary combustion air intake is in fluid communication with the annular space.

Preferably the inner hull comprises an open bottom end that terminates at a spaced elevation above a bottom end of the outer hull, whereby the combustion chamber air inlet is defined at least partially by said open bottom end of the inner hull, and the flame opening of the burner is in fluid communication with the annular space via the open bottom end of the inner hull, through which airflow is controllable by said airflow control device.

According to another aspect of the invention, there is provided a waste gas combustion apparatus comprising:

a stack structure delimiting an interior space that comprises an upper chimney space and a lower combustion chamber situated below said upper chimney space; the stack structuring comprising an inner hull whose interior defines the chimney space and the combustion chamber, an outer hull circumferentially surrounding the inner hull to delimit an annular space between the inner and outer hulls, and an ambient air intake residing at an elevation above the combustion chamber and communicating the annular space with an external environment outside the outer hull to admit ambient air to said annular space, whereby said ambient air is pre-heated by combustion heat from the chimney space and the combustion chamber;

a burner supported in the interior space of the stack structure, said burner comprising a primary combustion air intake positioned at an elevation below the ambient air intake and in fluid communication with the annular space to receive the pre-heated ambient air therefrom, and one or more flame outlets positioned in the combustion chamber inside the inner hull; and a liquid containment/vaporization chamber installed at an elevation below the burner in a position of heat-exchange relation to a flow path of the pre-heated ambient air from the annular space to the primary combustion air intake of the burner, said liquid containment/vaporization chamber comprising:

a waste gas inlet connected or connectable to a waste gas supply line to receive waste gas from an external source; and a connection to the burner to transfer the received waste gas thereto from the liquid containment/vaporization chamber.

The liquid containment/vaporization chamber preferably resides externally of the inner hull.

The liquid containment/vaporization chamber preferably resides externally of the outer hull.

The liquid containment/vaporization chamber is preferably mounted to a closed bottom end of the stack.

Preferably the inner hull has an open bottom end residing at a spaced elevation above a closed bottom end of the outer hull, and a transitional space resides between the bottom ends of the inner and outer hulls and defines the flow path by which the primary combustion air intake of the burner is fluidly communicated with the annular space to receive the pre-heated ambient air therefrom.

Preferably the liquid containment/vaporization chamber is mounted to the closed bottom end of the outer hull.

According to yet another aspect of the invention, there is provided a method of handling liquid contaminants in a waste gas stream feeding a waste gas combustion apparatus, said method comprising:

(a) during routing of said waste gas stream to a burner of the waste gas combustion apparatus, routing said waste gas stream through a liquid containment/vaporization chamber of said waste gas combustion apparatus; and (b) using a stream of pre-heated combustion air destined for the burner of the waste gas burner to heat the liquid containment/vaporization chamber.

BRIEF DESCRIPTION OF THE DRAWINGS

Preferred embodiments of the invention will now be described in conjunction with the accompanying drawings in which.

DETAILED DESCRIPTION

Figure 1:
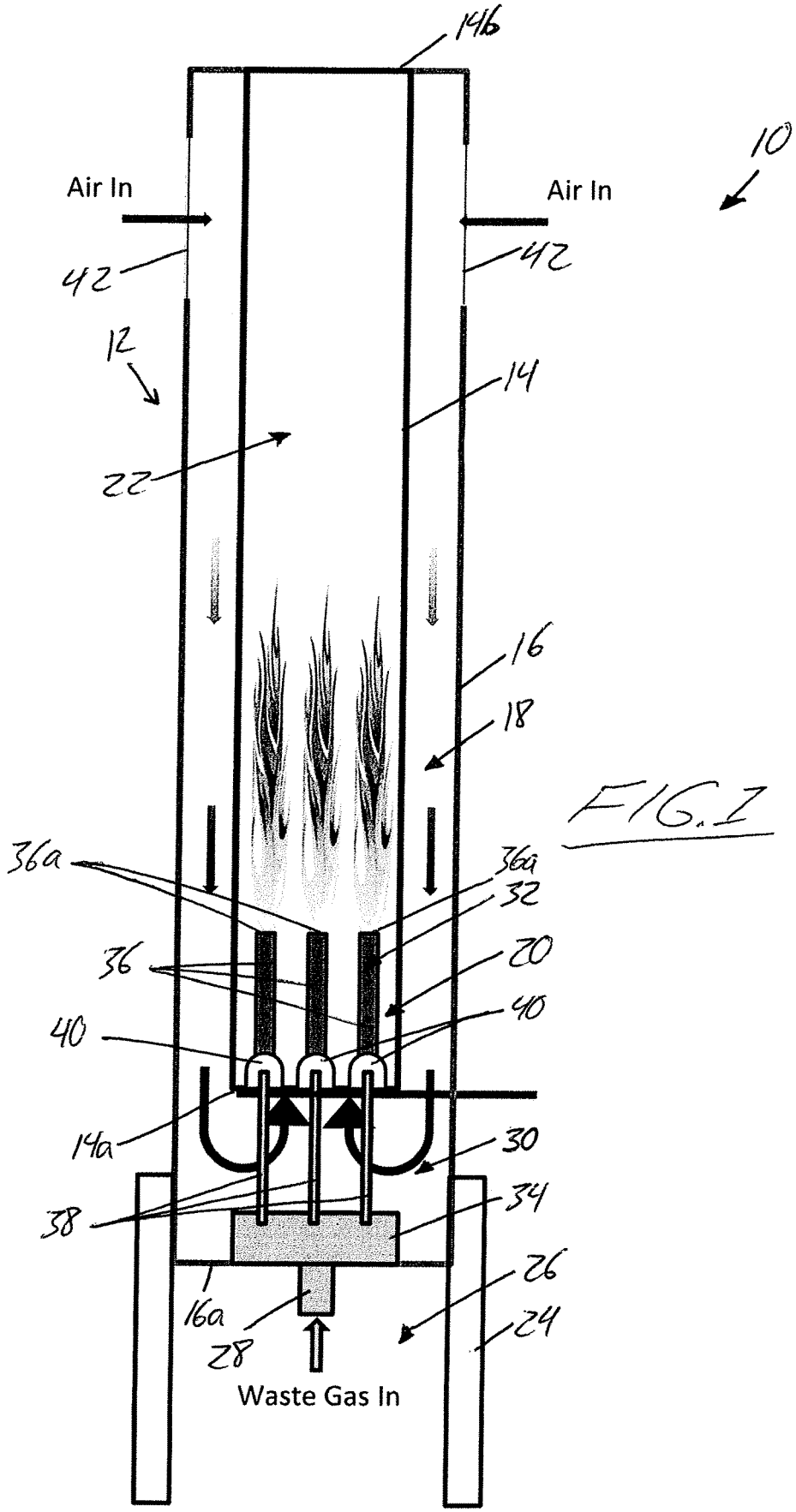
FIG. 1 is a schematic vertically sectioned elevational view of a waste gas combustion apparatus according to a first embodiment of the present invention.

The drawings illustrate preferred embodiments of the present invention in which a waste gas combustion apparatus 10 (or gas flare) is useful for burning excess combustible gas. An example of one particular application for such apparatus is for the burning of excess gas at a hydrocarbon production or storage site. The apparatus features a dual-hulled stack structure 12 featuring a cylindrical inner hull 14 standing vertically upright inside a cylindrical outer hull 16 of larger diameter. The outer hull 16 is spaced radially outward from the inner hull in order to leave an annular space 18 between the two hulls 14, 16. An interior of the inner hull 16 denotes a lower combustion chamber 20 in which the combustion of received waste gas is performed, and an upper chimney space 22 spanning upwardly from the combustion chamber to an open upper end **14*b* of the inner hull 14**, where exhaust gas from the combustion process is released to the external environment outside the stack structure.

At a bottom of the stack structure, the outer hull 16 features a closed bottom end **16*a*, which as shown may be elevated upwardly from an underlying ground or support surface by a suitable support base 24. This creates an available access space 26 between the bottom end of the stack structure and the underlying ground or support surface to enable routing a waste gas supply line to a waste gas inlet 28 that penetrates the otherwise closed bottom end 16*a* of the outer hull. The inner hull has an open bottom end 14*a* residing at a spaced elevation above the closed bottom end 16*a* of the outer hull, thus leaving a transitional space 30** between the bottom ends of the two hulls by which the combustion chamber is fluidly communicated with the annular space in order to receive incoming airflow therefrom.

The chimney space, combustion chamber, transitional space and annular space collectively denote an overall interior space of the stack structure inside the outer hull. A burner assembly 32 supported within the interior space of the stack structure features a gas intake manifold 34 that is situated in the transitional space at or adjacent the bottom end **16*a* of the outer hull and is fed by the waste gas inlet 28, a set of burner tubes 36 that reside in the combustion chamber at or near the bottom end 14*a* of the inner hull 14, and a plurality of connection lines 38 that each connect a respective one of the burner tubes 36 to the manifold through the transitional space. In a known manner, a lower end of each burner tube 36 features an inlet venturi 40, where waste gas from the manifold enters the burner tube via an orifice fitting at the end of the respective connection line. Through venturi effect, the incoming waste gas draws a primary flow of combustion air into the burner tube 36 to mix with the incoming waste gas. The venturi inlets of the multiple burner tubes thus collectively form a primary combustion air intake of the burner assembly. A suitably positioned pilot (seen in FIGS. 3 and 4) ignites the gas/air mixture, combustion of which causes flames to rise from the burner tubes via flame openings 36*a* situated at the top ends thereof in spaced elevation above the venturi inlets 40**.

The annular space of the stack structure is fluidly communicated with the external environment by an ambient air intake, for example in the form of one or more openings 42 in the circumferential wall of the outer hull near the top end thereof in order to enable admission of ambient air to the annular space in a radially inward direction. Additionally or alternatively, the annular space may be open at the top end thereof for admission of ambient air into the annular space in an axially downward direction. This ambient air admitted into the annular space at and/or near the top end thereof travels downwardly therethrough to the transitional area 30, at which this incoming ambient air changes direction to turn upwardly into the combustion chamber 20 inside the inner hull 14. Here, at or near the bottom of the combustion chamber 20, some of this incoming ambient is drawn into the venturi inlets of the burner tubes to form the primary combustion airflow needed to mix with the incoming waste gas to enable ignition thereof. A remainder of the incoming ambient air continues upwardly past the venturi inlets 40 along the outsides of the burner tubes 36 to form a secondary combustion airflow moving upwardly toward the flame openings at the top ends of the burner tubes. The secondary airflow helps ensure complete combustion, thereby preventing or reducing release of unburned waste gas to the environment through the chimney space 22.

Figure 2:
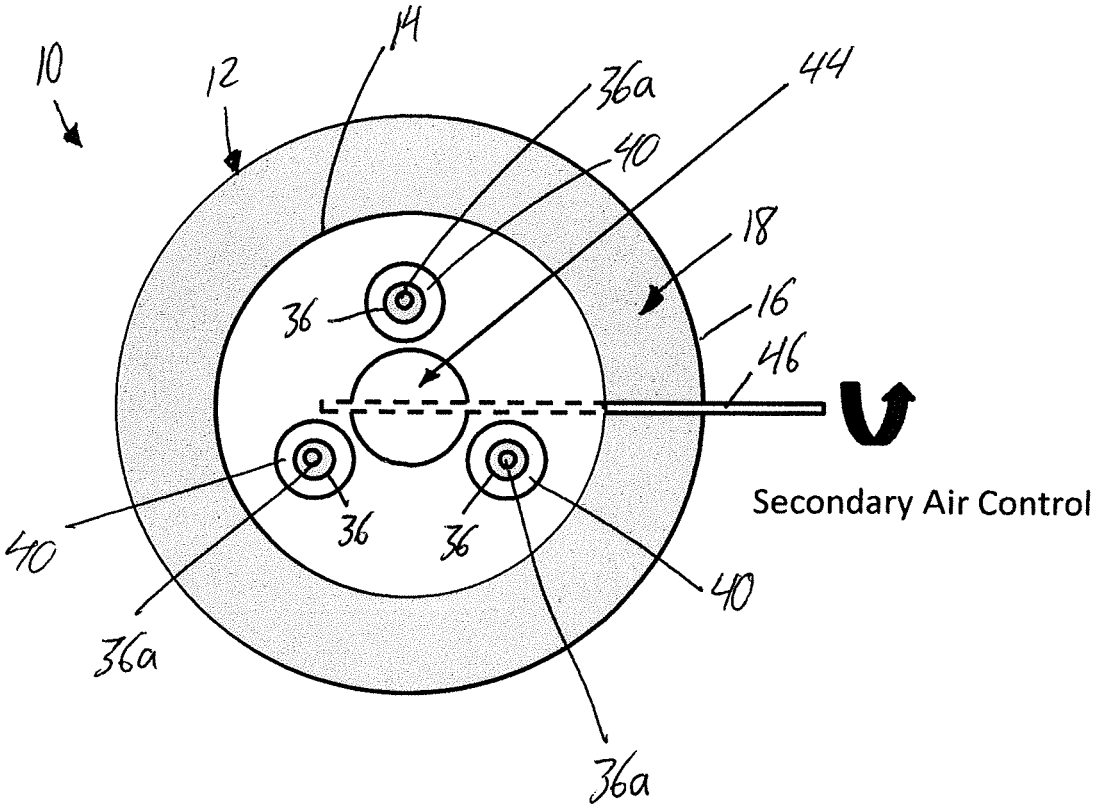
FIG. 2 is a schematic overhead plan view of the waste gas combustion apparatus of FIG. 1.

In the first embodiment shown in FIGS. 1 and 2, a butterfly damper 44 is installed at or near the open bottom 14*a* of the inner hull 14 so as to reside in or near the bottom end of the combustion chamber 20 or the upper end of the transitional space 30. The damper 44 serves as an airflow control device for controlling or regulating the secondary airflow from the open bottom end 14*a* of the inner hull 14 toward the flame openings 36*a* of the burner tubes 36. The damper 44 is disposed centrally of the concentric inner and outer hulls 14, 16, and thus resides on a vertically upright central axis shared by the inner and outer hulls of the stack structure. The burner tubes 36 are arranged in a circular array evenly distributed around this central axis at a radial distance therefrom that slightly exceeds the radius of the butterfly damper. In other words, the radial distance of each burner tube from the central axis is slightly greater than half of the damper's diameter. The burner tubes 36 are therefore distributed at evenly spaced angular intervals around the damper 44. The damper 44 is thus operable between a closed airflow-obstructing position substantially closing off the central area between the array of burner tubes to prevent upward airflow therethrough, and an open airflow-enabling position substantially revealing this central area to permit upward airflow therethrough. An annular area between the outer perimeter of the damper 44 and the inner wall surface of the inner hull 14 is left open, except at the sub-regions thereof occupied by the burner component. Accordingly, an outer stream of secondary airflow is always allowed upwardly through the combustion chamber 20 from the open bottom end 14*a* of the inner hull 14 to the flame openings 36*a* of the burner tubes through this annular area, while an inner stream of secondary airflow through the damper-occupied central area can be controlled to vary or regulate the overall secondary airflow.

To control the damper between its open and closed positions, and any intermediary position therebetween, an actuation shaft 46 passes radially through the circumferential walls of the inner and outer hulls 14, 16 between the damper 44 and the external environment outside the stack structure. Here, the actuation shaft 46 may be equipped with a manual actuator handle for manual adjustment of the damper position, or equipped with a motorized or other powered actuator, whether operating on an automated, semi-automated or human monitored/controlled basis.

In the illustrated embodiments, the open bottom end of the inner hull serves as a combustion chamber air inlet by which incoming ambient air is axially admitted to the combustion chamber for both primary and secondary airflow purposes. Other embodiments may depart from this particular configuration while still employing the novel use of a butterfly damper or other airflow control device operable to adjust or regulate the secondary airflow to the flame outlets of the burner tubes. For example, the inner hull may continue further downwardly toward the bottom end of the outer hull, and feature one or more air inlet ports opening through the inner hull's circumferential wall to admit the ambient air into the combustion chamber in a radial fashion at an elevation below the damper and below the venturi inlets of the burner tubes. Also, while the first embodiment benefits from the dual-hulled stack design, where the incoming ambient air cools the exterior of the inner hull and pre-heats the incoming air for improved combustion efficiency, it will be appreciated that the benefits of the secondary airflow control by the damper or other airflow control device could also be employed in a single-hull stack structure.

Figure 3:
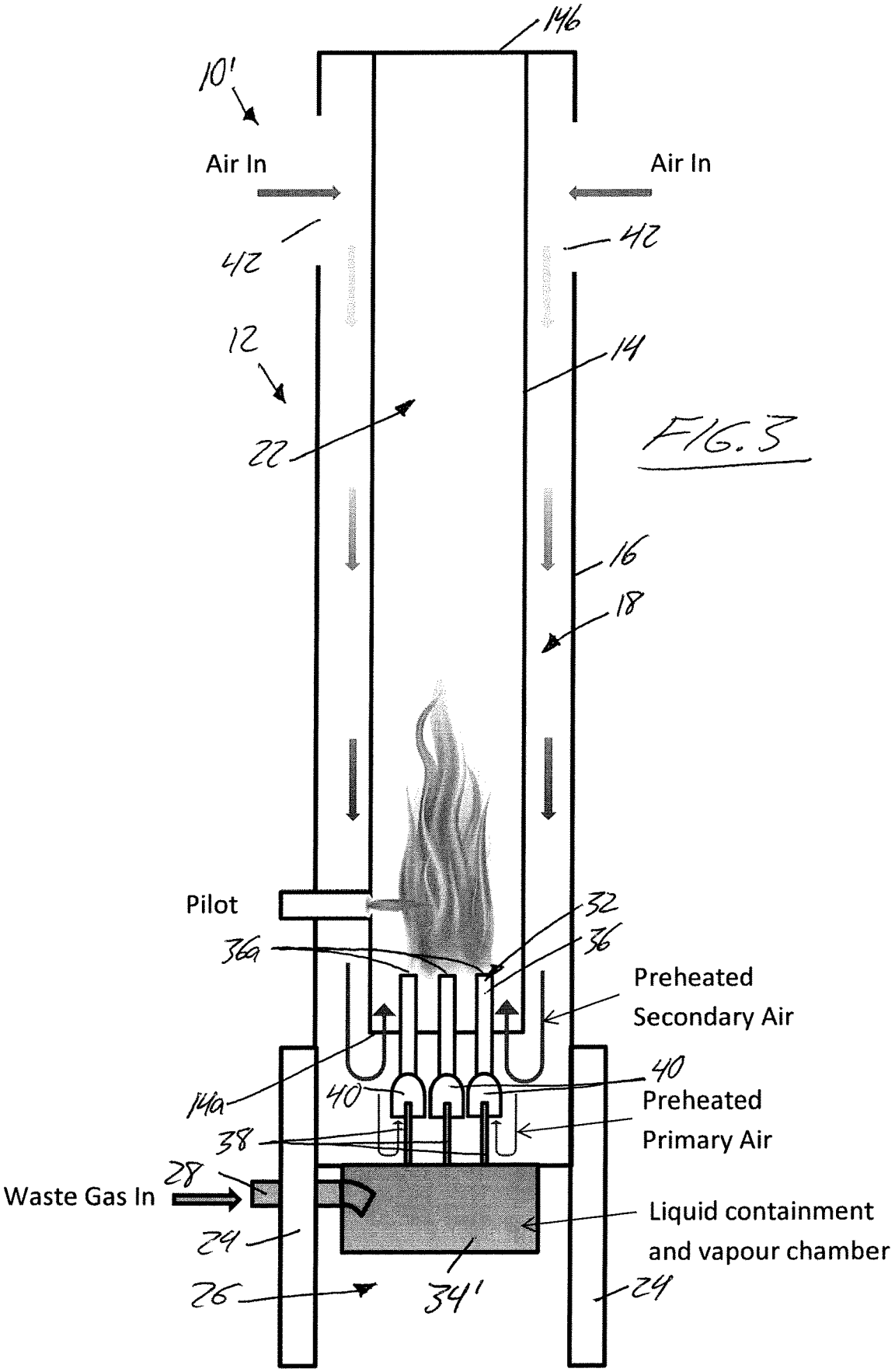
FIG. 3 is a schematic vertically sectioned elevational view of a waste gas combustion apparatus according to a second embodiment of the present invention.
Figure 4:
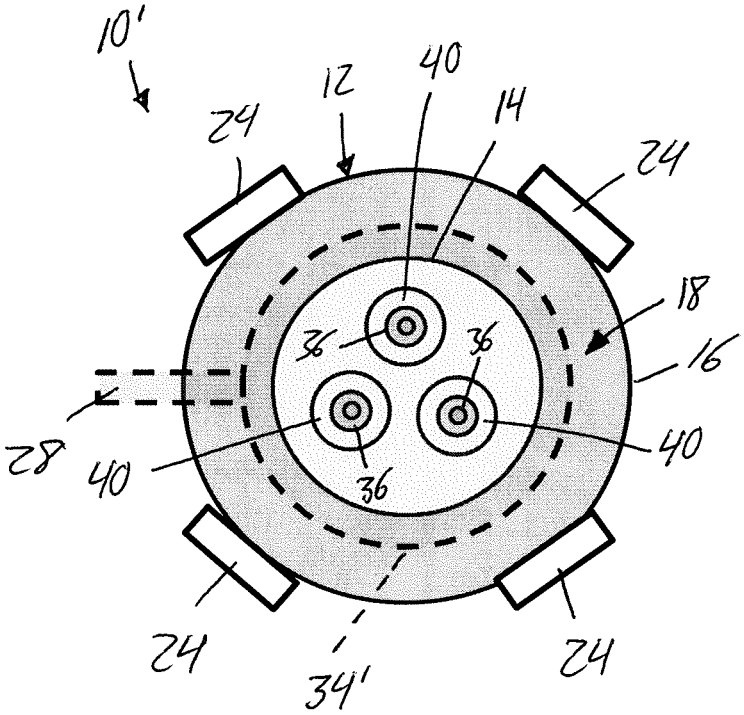
FIG. 4 is a schematic overhead plan view of the waste gas combustion apparatus of FIG. 3.

FIGS. 3 and 4 illustrate a second embodiment waste gas combustion apparatus 10 (or gas flare), in which the damper for secondary airflow control may optionally be employed, though it is omitted in the illustrated example. The stack in the second embodiment has the same double-hull design, in which the chimney space, combustion chamber, transitional space and annular space collectively denote an overall interior space of the stack structure inside the outer hull. The burner assembly once again comprises a set of burner tubes 36 positioned with their flame openings 36*a* resides inside the combustion chamber in elevated relation above the inlet venturi 40. In the illustrated example of the second embodiment, the inlet venturi 40 are situated lower down in the stack, residing in the transitional space 30 at a spaced distance below the bottom end 14*a* of the inner hull, instead of residing inside the combustion chamber of the inner hull. Either way, the inlet venturi once again define a primary combustion air intake of the burner, which resides in fluid communication with the annular space in which the combustion air is preheated as it travels down the exterior of the hot chimney space and combustion chamber defined by the inner hull.

Instead of a gas intake manifold 34 positioned inside the outer hull at the transitional space 30, the second embodiment features an externally mounted liquid containment/vaporization chamber 34' mounted to the closed bottom end of the outer hull at the bottom end of the stack, thus being suspended therefrom in the access space 30 between the stack and underlying ground surface. The waste gas inlet 28 laterally enters the liquid containment/vaporization chamber 34' from the side, via a open area between two legs of the support structure 24, where a waste gas supply line can be connected to feed the apparatus with waste gas from an external supply. Like the internally mounted manifold of the first embodiment, the externally mounted liquid containment/vaporization chamber 34' feeds a plurality of connection lines 38 each connected to the venturi inlet of a respective one of the burner tubes 36 to feed the received waste gas thereto. Due to the less-elevated positions of the venturi inlets in the second embodiment, they are closer to the liquid containment/vaporization chamber 34' then they were to the inlet gas manifold 34 in the first embodiment, despite the externally mounted position of the liquid containment/vaporization chamber 34'.

The venturi effect caused by the incoming waste gas at the venturi inlets 41 of the burner tubes draws the pre-heated ambient air from the annular space of the double hulled stack into the burner tubes 36 to serve as the source of primary combustion air. In the illustrated example, where the venturi inlets resides at spaced elevation below the combustion chamber of the inner hull closer to the bottom end 16*a* of the outer hull, the preheated ambient air being drawn into the venturi inlets is drawn downward from the annular space to near the bottom end of the transitional space, thus reaching into closely-adjacent heat-exchange relationship with the liquid containment/vaporization chamber 34' mounted at this bottom end of the stack. Accordingly, the transitional flow path of the preheated primary combustion flowing down the annular space and then turning upward into the venturi inlets 40 of the burner air serves to warm the liquid containment/vaporization chamber 34', which is also warmed by radiant heat emanating downward from the combustion chamber above.

This heating of the liquid containment/vaporization chamber 34' helps increase the lifespan of the burner assembly and combustion chamber by preventing corrosion, plugging or other detrimental effects of contaminant liquids (e.g. water, hydrocarbons) that may be carried in the incoming waste gas. The heated state of the liquid containment/ vaporization chamber 34' helps prevent saturated gas from condensing out liquids and carrying free liquids to venturi inlets and burner tubes. At the same time, the containment/vaporization chamber 34' knocks out any entrained liquids that can be carried over by the flow of gas. The heated state of the liquid containment/vaporization chamber 34' assists in transforming any accumulated liquids into the vapor state.

Turning back to the first embodiment, it will be appreciated that the gas intake manifold 34 in that embodiment, like the liquid containment/vaporization chamber 34' in the second embodiment, also effectively serves as a gas plenum placed in close heat-exchange relation to the pre-heated combustion airflow so that the pre-heated combustion air and radiant heat from the combustion air can likewise heat the plenum and have the same beneficial handling of contaminant liquids in the waste gas stream. However, the external placement of the liquid containment/vaporization chamber 34' in the second embodiment has several advantages. The external placement allows for entry of the waste gas inlet 28 to the liquid containment/vaporization chamber 34' in a lateral direction from the side, whereas routing of the gas inlet 28 upwardly into the bottom of the plenum in the first embodiment means that any free liquids condensing or pooling in the plenum may gravitationally fall back into the gas supply line, whereas the side-fed design in the second embodiment would prevent such liquid backup into the gas supply line. The external placement also enables a direct visual sight line to the chamber, allowing a sight level to be operably installed thereon to ensure a level orientation of the chamber to prevent imbalanced liquid accumulation therein. The external placement also enables easier access to the chamber for inspection and cleanout. Furthermore, the external placement reduces component occupancy inside the stack, providing more room to accommodate the combustion chamber, chimney space and burner with a given overall height of the structure.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A waste gas combustion apparatus comprising:

a stack structure delimiting an interior space that comprises an upper chimney space and a lower combustion chamber situated below said upper chimney section;

an ambient air intake through which ambient air is admissible to the stack to feed combustion in the combustion chamber;

a burner assembly supported in the interior space of the stack structure, said burner assembly comprising one or more burner tubes having a primary combustion air intake that is situated at a bottom of said one or more burner tubes and in fluid communication with the ambient air intake to admit a first fraction of said ambient air into the one or more burner tubes to serve as primary combustion air therein, and one or more flame outlets positioned in the combustion chamber at a top of said one or more burner tubes in elevated relation to the primary combustion air intake;

a waste gas inlet from which one or more connection lines extend to the one or more burner tubes to deliver incoming waste gas thereinto, thereby forming an air/gas mixture of said incoming waste gas and said primary combustion air inside the burner tube;

a pilot operably positioned near the one or more flame outlets of the one or more burner tubes to ignite said air/gas mixture and thereby generate a flame rising from said one or more flame outlets of the one or more burner tubes;

an airflow control device residing within in the interior space of the stack structure at an elevation that is above the primary combustion air intake and below both the pilot and the one or more flame outlets in a position operable to regulate air flow of a second fraction of said ambient air from the ambient air intake that flows past the primary combustion air intake to the one or more flame outlets of the one or more burner tubes, without obstructing admission of the primary combustion air through the primary combustion air intake.

2. The apparatus of claim 1 wherein the burner assembly is a multi-tube burner assembly comprising a plurality of burner tubes distributed around a central area in which the airflow control device resides.

3. The apparatus of claim 2 wherein said burner tubes are disposed in a non-linear array around the airflow control device.

4. The apparatus of claim 2 wherein said burner tubes are disposed in a circular array around the airflow control device.

5. The apparatus of claim 1 wherein said airflow control device comprises a butterfly damper.

6. The apparatus of claim 1 wherein said airflow control device is coupled to an actuator situated externally of the interior space of the stack structure.

7. The apparatus of claim 1 wherein:

the stack structure comprises an inner hull whose interior defines the chimney space and the combustion chamber, and an outer hull circumferentially surrounding the inner hull to delimit an annular space between the inner and outer hulls;

the ambient air intake communicates the annular space with an external environment outside the outer hull; and the primary combustion air intake is in fluid communication with the annular space.

8. The apparatus of claim 7 wherein the inner hull comprises an open bottom end that terminates at a spaced elevation above a bottom end of the outer hull, and the one or more flame outlets of the one or more burner tubes are in fluid communication with the annular space via the open bottom end of the inner hull, through which airflow is controllable by said airflow control device.

9. A waste gas combustion apparatus comprising:

a stack structure delimiting an interior space that comprises an upper chimney space and a lower combustion chamber situated below said upper chimney space; the stack structuring comprising an inner hull whose interior defines the chimney space and the combustion chamber, an outer hull circumferentially surrounding the inner hull to delimit an annular space between the inner and outer hulls, and an ambient air intake residing at an elevation above the combustion chamber and communicating the annular space with an external environment outside the outer hull to admit ambient air to said annular space, whereby said ambient air is pre-heated by combustion heat from the chimney space and the combustion chamber;

a burner assembly supported in the interior space of the stack structure, said burner assembly comprising one or more burner tubes having a primary combustion air intake situated at a bottom of said one or more burner tubes at an elevation below the ambient air intake and in fluid communication with the annular space to receive the pre-heated ambient air therefrom to serve as primary combustion air in said one or more burner tubes, and one or more flame outlets at a top of said one or more burner tubes and within the combustion chamber inside the inner hull;

a liquid containment/vaporization chamber installed at an elevation below the burner in a position of heat-exchange relation to a flow path of the pre-heated ambient air from the annular space to the primary combustion air intake of the burner;

a waste gas inlet feeding into the liquid containment/vaporization chamber and connected or connectable to a waste gas supply line to receive incoming waste gas from an external waste gas source; and one or more connection lines extending from the liquid containment/vaporization chamber to the one or more burner tubes to deliver said incoming waste gas thereto from the liquid containment/vaporization chamber, thereby forming an air/gas mixture of said incoming waste gas with said primary combustion air inside the one or more burner tubes; and a pilot operably situated at a position of upwardly elevated relation to the primary air intake of the one more burner tubes and nearer to the one or more flame outlets of the one or more burner tubes than to the primary air intake thereof so as to ignite said air/gas mixture as it is emitted from the one or more flame outlets, thereby generating a flame rising from said one or more flame outlets of said one or more burner tubes;

wherein the liquid containment/vaporization chamber is of enlarged internal size relative both to said waste-gas inlet and to said one or more connection lines so as to thereby form a localized enlargement in an overall flow path of the waste gas from the waste gas supply line to the burner, the heat exchange relation of the position of the liquid containment/vaporization chamber relative the flow path of the pre-heated ambient air is operable to warm the liquid containment/vaporization chamber to a heated state, thereby reducing potential condensation of liquids from saturated waste gas, and the enlarged internal size of the liquid containment/vaporization chamber and placement thereof between the waste gas inlet and connection lines is operable to knock entrained liquids out from the incoming waste gas, whereupon said knocked out liquids are at least partially vaporizable by said heated state of the liquid containment/vaporization chamber, whereby the liquid containment/vaporization chamber is operable to reduce potential carrying of free liquids to the burner tubes.

10. The apparatus of claim 9 wherein the liquid containment/vaporization chamber resides externally of the inner hull.

11. The apparatus of claim 9 wherein the liquid containment/vaporization chamber resides externally of the outer hull.

12. The apparatus of claim 9 wherein the liquid containment/vaporization chamber is mounted to a closed bottom end of the stack.

13. The apparatus claim 9 wherein the inner hull has an open bottom end residing at a spaced elevation above a closed bottom end of the outer hull, and a transitional space resides between the bottom ends of the inner and outer hulls and defines the flow path by which the primary combustion air intake of the burner is fluidly communicated with the annular space to receive the pre-heated ambient air therefrom.

14. The apparatus of claim 13 wherein the liquid containment/vaporization chamber is mounted to the closed bottom end of the outer hull.

15. The apparatus of claim 9 wherein the waste gas inlet feeds laterally into the liquid containment/vaporization chamber from a side thereof.

16. A method of handling liquid contaminants in a waste gas stream feeding a waste gas combustion apparatus, said method comprising:

(a) during routing of said waste gas stream to a burner of the waste gas combustion apparatus, routing said waste gas stream from a waste gas supply line through a waste gas inlet into a liquid containment/vaporization chamber from which the waste gas stream is then routed through one or more connection lines extending from said containment/vaporization chamber to one or more burner tubes of the burner, in which the waste gas stream is mixed with primary combustion air to create an ignitable gas/air mixture that is then ignited by a pilot operably positioned in elevated relation above a primary air intake of the one or more burner tubes and nearer to one or more flame outlets of said one or more burner tubes than to said primary air intake of the one or more burner tubes so as to ignite said air/gas mixture as it is emitted from the one or more flame outlets, said liquid containment/vaporization chamber being of enlarged internal size relative both to said waste gas inlet and to said one or more connection lines so as to thereby form a localized enlargement in an overall flow path of the waste gas from the waste gas supply line to the burner; and (b) using a stream of pre-heated combustion air destined for the primary air intake of the one or more burner tubes of the burner to heat the liquid containment/vaporization chamber, whereby a resulting heated state of the liquid containment/vaporization chamber reduces potential condensation of liquids from saturated waste gas, and the enlarged size of the liquid containment/vaporization chamber and placement thereof upstream of the connection lines is operable to knock entrained liquids out from the waste gas stream, whereupon said knocked out liquids are at least partially vaporizable by said heated state of the liquid containment/vaporization chamber, whereby the liquid containment/vaporization chamber is operable to reduce potential carrying of free liquids to the burner tubes.

17. The method of claim 16 wherein the waste gas combustion apparatus comprises a stack structure delimiting an interior space that comprises an upper chimney space and a lower combustion chamber situated below said upper chimney space; the stack structuring comprising an inner hull whose interior defines the chimney space and the combustion chamber, an outer hull circumferentially surrounding the inner hull to delimit an annular space between the inner and outer hulls, and an ambient air intake residing at an elevation above the combustion chamber and communicating the annular space with an external environment outside the outer hull to admit ambient air to said annular space, whereby said ambient air is pre-heated by combustion heat from the chimney space and the combustion chamber to form said stream of pre-heated combustion air, and the primary air intake is in fluid communication with the annular space to receive said pre-heated combustion air.

18. The apparatus of claim 9 wherein said waste gas inlet is connected to said external waste gas source.

19. The apparatus of claim 9 wherein ambient air intake directly communicates with an ambient environment situated immediately outside the stack structure.

20. The apparatus of claim 1 wherein the burner assembly is a multi-tube burner assembly comprising a plurality of burner tubes, each burner tube stands in an upright orientation, the primary combustion air intake of the burner comprises a plurality of venturi inlets that each reside at a lower end of a respective one of the burner tubes, the one or more flame outlets comprises a plurality of flame outlets respectively defined in the burner tubes at top ends thereof, the one or more connection lines comprise a plurality of connection lines respectively feeding the incoming waste gas into the plurality of venturi inlets through respective orifices at a respective ends of said connection lines such that the incoming waste gas entering the burner tubes via the venturi inlets draws said primary combustion air, through venturi effect, into the burner tubes to mix with said incoming waste gas and thereby form said gas/air mixture.

21. The apparatus of claim 9 wherein the one or more burners tubes each have a respective inlet venturi and the primary air intake at the bottom of said one or more burner tubes is composed of said respective inlet venturi, into which the one or more connection lines from the liquid containment/vaporization chamber feed the waste gas so as to draw the primary combustion air into the one or more burner tubes, via venturi effect, to mix with said incoming waste gas and thereby form said gas/air mixture.

22. The method of claim 16 wherein the one or more burners tubes each have a respective inlet venturi and the primary air intake is composed of said respective inlet venturi of the one or more burner tubes, into which the one or more connection lines from the liquid containment/vaporization chamber feed the waste gas so as to draw the primary combustion air into the one or more burner tubes, via venturi effect, to mix with said incoming waste gas and thereby form said gas/air mixture.

* * * * *